US009850113B2

(12) United States Patent
Melin et al.

(10) Patent No.: US 9,850,113 B2
(45) Date of Patent: Dec. 26, 2017

(54) USER INTERFACE FOR A PORTABLE POWER DRIVEN SYSTEM

(71) Applicant: Actsafe Systems AB, Lindome (SE)

(72) Inventors: Michael Melin, Göteborg (SE); Peter Sundman, Vallda (SE)

(73) Assignee: Actsafe Systems AB, Lindome (SE)

( * ) Notice: Subject to any disclaimer, the term of this patent is extended or adjusted under 35 U.S.C. 154(b) by 570 days.

(21) Appl. No.: 14/628,389

(22) Filed: Feb. 23, 2015

(65) Prior Publication Data

US 2015/0246796 A1 Sep. 3, 2015

(30) Foreign Application Priority Data

Mar. 3, 2014 (EP) ..... 14157466

(51) Int. Cl.

| | |
|---|---|
| ***B66D 3/20*** | (2006.01) |
| ***B66D 3/00*** | (2006.01) |
| ***B66D 1/74*** | (2006.01) |

(52) U.S. Cl.

CPC ..... *B66D 3/20* (2013.01); *B66D 1/7415* (2013.01); *B66D 3/006* (2013.01)

(58) Field of Classification Search

CPC ..... B66D 3/20; B66D 3/006; B66D 1/7415; H01H 1/20; H01H 11/0018

See application file for complete search history.

(56) References Cited

U.S. PATENT DOCUMENTS

| | | | | | |
|---|---|---|---|---|---|
| 522,990 | A * | 7/1894 | Kopp | A62B 1/10 | 182/240 |
| 1,396,721 | A * | 11/1921 | Atwood | B66D 1/00 | 254/322 |
| 1,500,943 | A * | 7/1924 | Jolkovski | A62B 1/10 | 182/236 |
| 1,631,279 | A * | 6/1927 | Mandy | A62B 1/10 | 182/235 |
| 1,826,490 | A * | 10/1931 | Abbe | B66F 9/08 | 414/640 |
| 2,561,832 | A * | 7/1951 | Wilson | A62B 1/10 | 182/235 |
| 2,569,597 | A * | 10/1951 | Bailey, Sr. | A62B 1/10 | 182/235 |
| 2,861,700 | A * | 11/1958 | James | B25J 9/102 | 212/282 |

(Continued)

FOREIGN PATENT DOCUMENTS

| | | |
|---|---|---|
| WO | 99/24122 | 5/1999 |
| WO | 2004/065280 | 8/2004 |
| WO | 2011/036520 | 3/2011 |

OTHER PUBLICATIONS

Omiros Verheul, European Search Report for corresponding EP Application 14157466.5, dated Jul. 3, 2014, The Hague The Neverlands.

*Primary Examiner* — Michael E Gallion
(74) *Attorney, Agent, or Firm* — Babcock IP, PLLC

(57) ABSTRACT

The present invention relates to a user interface for a portable power driven system, specifically in relation to an integrated user interface for controlling such an arrangement, and being applicable for example in relation to an ascender/descender arrangement. The invention also relates to a corresponding method and computer program product for operating such a portable power driven system.

12 Claims, 6 Drawing Sheets

(56) References Cited

U.S. PATENT DOCUMENTS 3,016,973 A * 1/1962 Williamson ..... B66F 9/07572 180/13
3,528,574 A * 9/1970 Denner ..... B60P 1/445 182/127
3,608,864 A * 9/1971 Dargitz ..... B66D 1/48 254/274
3,669,223 A * 6/1972 Arnold ..... A62B 1/10 182/234
3,681,565 A * 8/1972 Fisher ..... B23K 9/0209 182/142
3,687,249 A * 8/1972 Priest ..... B66D 1/14 192/215
RE28,273 E * 12/1974 Brda ..... A62B 1/14 182/193
3,915,432 A * 10/1975 Bustamante ..... B66D 1/06 182/239
4,290,584 A * 9/1981 Eckels ..... B66D 1/08 242/390.8
4,359,139 A * 11/1982 Bloder ..... A62B 1/10 182/234
4,457,400 A * 7/1984 Donaldson ..... A62B 1/10 182/234
4,493,396 A * 1/1985 Borgia, V ..... A62B 1/08 182/233
4,512,440 A * 4/1985 Bixby ..... B66B 9/16 182/134
4,520,895 A * 6/1985 Armstrong ..... A62B 1/02 182/3
4,602,698 A * 7/1986 Grant ..... A01M 31/02 182/142
4,603,839 A * 8/1986 Ekman ..... B66D 1/7415 254/329
4,729,454 A * 3/1988 Barelli ..... A62B 1/10 182/234
4,730,703 A * 3/1988 Neuendorf ..... A62B 1/10 182/235
4,811,803 A * 3/1989 Green ..... A01M 31/02 180/7.5
4,986,390 A * 1/1991 Kikuchi ..... A62B 1/10 182/234
5,131,491 A * 7/1992 Varner ..... A62B 1/06 182/7
5,507,471 A * 4/1996 Mercurio ..... B66C 1/18 254/134.3 R
5,607,143 A * 3/1997 Regal ..... B66D 1/04 254/342
5,663,541 A * 9/1997 McGregor, II ..... H01H 1/20 200/17 R
5,915,673 A * 6/1999 Kazerooni ..... B66C 1/62 212/285
5,927,438 A * 7/1999 Ostrobrod ..... A62B 1/08 182/192
6,079,517 A * 6/2000 Payne ..... A01M 31/02 182/133
6,283,455 B1 * 9/2001 Ascherin ..... B64D 1/22 242/397.5
6,386,513 B1 * 5/2002 Kazerooni ..... B66C 1/0212 212/285
6,412,602 B1 * 7/2002 Sundman ..... A62B 1/14 182/133
6,634,621 B2 * 10/2003 Keith ..... B66C 23/022 254/270
6,705,597 B1 * 3/2004 Reilly ..... B60P 7/0846 254/223
6,988,587 B1 * 1/2006 Smith ..... A62B 1/10 182/71
7,237,651 B2 * 7/2007 Avots ..... A62B 1/10 182/234
7,275,710 B2 * 10/2007 VanDruff ..... B64D 1/445 182/127
7,810,791 B2 * 10/2010 DeVos ..... B66D 3/18 212/285
7,909,139 B2 * 3/2011 Blue ..... A01M 31/02 182/103
7,934,698 B2 * 5/2011 Ball ..... B66D 1/7415 182/133
8,316,994 B1 * 11/2012 Rands ..... B66B 9/187 182/141
8,567,561 B2 * 10/2013 Strasser ..... A62B 1/10 182/234
8,950,734 B2 * 2/2015 Ogawa ..... B66C 13/44 254/267
9,334,143 B2 * 5/2016 Ogawa ..... B66C 13/40
9,427,606 B2 * 8/2016 Ball ..... A62B 1/06
2006/0011414 A1 * 1/2006 Sundman ..... A62B 35/0037 182/6
2006/0273293 A1 * 12/2006 Ball ..... A62B 99/00 254/371
2008/0203370 A1 * 8/2008 Ball ..... B66D 1/7415 254/372
2008/0302601 A1 * 12/2008 Baker ..... B66B 9/16 182/69.4
2010/0145526 A1 * 6/2010 Yamaguchi ..... B66C 13/40 700/275
2013/0105430 A1 * 5/2013 Ogawa ..... B66C 13/40 212/282
2013/0306923 A1 * 11/2013 Hua ..... A62B 1/06 254/333
2015/0123058 A1 * 5/2015 Melin ..... B66D 1/7415 254/362
2015/0246796 A1 * 9/2015 Melin ..... B66D 3/20 254/362
2017/0107086 A1 * 4/2017 Boulliat ..... B66D 1/7415

* cited by examiner

USER INTERFACE FOR A PORTABLE POWER DRIVEN SYSTEM

TECHNICAL FIELD

The present invention relates to a user interface for a portable power driven system, specifically in relation to an integrated user interface for controlling such an system, and being applicable for example in relation to an ascender/descender arrangement. The invention also relates to a corresponding method and computer program product for operating such a portable power driven system.

BACKGROUND OF THE INVENTION

Powered personal lifting devices assist personnel in scaling vertical surfaces. Motorized winches are used to raise or lower personnel on platforms or harnesses attached to ropes. A winch must be anchored to a solid platform above the load or use pulleys coupled to the platform to hoist the load. Further, a winch winds the rope or cable on a spool which limits the length and weight of rope that can be used. Hoists, usually with compound pulleys or reducing gears are used to raise or lower individuals or platforms and must be suspended from a secure support point such as a tripod, beam or bridge crane. Typically a winch or hoist requires at least a second person to operate or control the device in order for a first person to safely ascend a rope.

There are however many examples of where it would be desirable to have access to a portable winch, preferable for a portable winch that can be operated by the person ascending or descending the rope. Such scenarios include for example mountain climbing, caving, tree trimming, rescue operations and military operations. Industrial uses of a climbing device may include scaling tall structures, towers, poles, mine shafts or bridge works for servicing, cleaning, window washing, painting, etc.

An example of such a portable winch is disclosed in U.S. Pat. No. 6,412,602. In U.S. Pat. No. 6,412,602 there is provided a promising approach to a portable climber operated winch, denoted as a climbing device, comprising a rotatable rope pulley connected to a motor, such as for example an internal combustion motor or an electric battery powered motor. During operation of the climbing device a rope is introduced in the rope pulley, and once the motor is engaged and starts to rotate, the rope pulley may advance the climber in a typically vertical direction along the rope.

Even though the above mentioned prior art shows a very useful solution for rope access to heights, there is always an endeavor to introduce further improvements for the personnel utilizing the equipment. Specifically, there is a desire to minimize any risks when working at heights, thereby improving the environment for the user of such equipment.

SUMMARY OF THE INVENTION

According to a first aspect of the invention, the above is at least partly alleviated by a portable power driven system for advancing a rope, the rope extending in a first main direction, the power driven system comprising an electrical motor, the electrical motor comprising a drive shaft, a rechargeable battery electrically connected to and configured for powering the electrical motor, a rope grab configured to receive the rope, the rope grab connected to the drive shaft of the electrical motor for rotation of the rope grab, a user interface configured for allowing a user to control the speed and direction for advancing the rope, and a main body for mounting the electrical motor, the battery, the rope grab and the user interface, the main body further comprising an anchoring point adapted to receive an anchoring force, the anchoring force extending in a second direction being essentially opposite to the first main direction, wherein the user interface comprises a rotatable handle configured to be rotated in a first and a second rotational direction, the handle having a neutral position, a first end position in the first rotational direction and a second end position in the second rotational direction, and wherein rotation of the handle in the first direction between the neutral position and the first end position generates a rotation of the rope grab in a first direction, and rotation of the handle in the second direction between the neutral position and the second end position generates a rotation of the rope grab in a second direction.

The invention is based on the understanding that the operation of the portable power driven system may be simplified in comparison to prior art devices by allowing a combined functionality of the user interface, provided in one single rotatable handle. The handle may accordingly be operated using a single hand of the user, making it possible for the user to at all times keep his hand at the handle and thus making it possible to rapidly change the direction in which the user is advancing the rope. Such a possibility may be specifically useful in relation to a military application where for example the user is approaching a possible enemy. In case of increased danger, the user may directly, without having to move his hand for operating a complex user interface, just switch rotational direction of the handle to rapidly move away form the possible danger and into safety.

As mentioned above, the motor is connected to the rope grab using the drive shaft. The expression "drive shaft" may include any mechanical implementation for transferring a rotational force from the motor to the rope grab. As such, the drive shaft may for example further include a gearbox or similar for adapting the rotational force to suit the rotational speed of the rope grab.

The term rope is here used in its broader sense and is intended to include ropes, wires and cords of whatever nature or size suitable for engaging with the rope grab. The robe grab may in one embodiment comprise a roller (may as be referred to as a rope pulley) formed to at least partly pinch the rope by means of a concave form such as a v- or u-shaped rope engaging face, the rope engaging face formed at the "inside" of the roller for receiving the rope. The inside of the roller may additionally comprise a plurality of ridges for further increasing the friction between the rope and the roller.

In addition, the portable system may further comprise wireless reception means configuring the system to be controlled from a distance using for example a remote control, thus allowing for example a second operator to control the portable power driven system from a distance.

The functionality of the handle may be designed in such a way that the rotational speed of the rope grab is based on the rotational angle of the handle. That is, in case a user is making an in comparison large rotation of the handle the rotational speed of the rope grab will in comparison be high. However, it may also be possible to further base the rotational speed of the rope grab on a predetermined correlation function. The predetermined correlation function may in one embodiment be non-linear. Such an implementation will be further discussed in relation to the detailed description of the invention.

Preferably, the neutral position is essentially centrally arranged in relation to the first and the second end position. However, as an alternative the neutral position may be arranged non-central in relation to the first and the second end position, all depending on the implementation desired by the operator of the portable power driven system.

In an embodiment of the invention there is further provided an elongated safety sling connected to the anchoring point, the safety sling arranged to receive at least one of a maillon, a carabiner, or a rigging plate. The sling may for example be of a textile material. The elongated sling is preferably at one of its ends connected to the anchoring point and configured to at its other end receive at least one of a maillon, a carabiner, or a rigging plate. The at least one of a maillon, a carabiner, or a rigging plate may then in turn be used for allowing connection of the portable system to e.g. a harness for a user, or for anchoring the system to a fixed structure using e.g. further climbing/fining equipment. The general term "elongated sling" is typically referred to as in relation to general climbing equipment. In addition, the term "textile" should be interpreted very broadly. For example, the textile material used for forming the sling may be of any type of e.g. woven or non-woven material, natural and/or synthetic fibers, etc.

During operation of the portable power driven system, the user is typically securely connected to the above discussed anchoring point, e.g. by means of the sling and carabiner. Accordingly, the handle of the user interface is preferably positioned at the main body of the portable power driven system within an arms length of a user, thus allowing easy operation. Preferably, the handle of the user interface is such positioned that it allows the user to control the handle between the first and the second end position when operated by a single hand of the user.

Preferably, the portable power driven system further comprises a hinged safety arrangement comprising a safety lid configured to be arranged in a closed state to cover the rope grab during operation of the power driven system, and to be arranged in an opened state for allowing introduction of the rope to the robe grab. Such a safety arrangement minimizes any risks of the user introducing e.g. a hand or similar, efficiently increasing the operational safety of the system.

According to a further aspect of the invention there is provided a method for operation of a portable power driven system for advancing a rope, the rope extending in a first main direction, the power driven system comprising an electrical motor, the electrical motor comprising a drive shaft, a rechargeable battery electrically connected to and configured for powering the electrical motor, a rope grab configured to receive the rope, the rope grab connected to the drive shaft of the electrical motor for rotation of the rope grab, a user interface configured for allowing a user to control the speed and direction for advancing the rope, the user interface comprises a rotatable handle configured to be rotated in a first and a second rotational direction, the handle having a neutral position, a first end position in the first rotational direction and a second end position in the second rotational direction, and a main body for mounting the electrical motor, the battery, the rope grab and the user interface, the main body further comprising an anchoring point adapted to receive an anchoring force, the anchoring force extending in a second direction being essentially opposite to the first main direction, wherein the method comprises rotating the handle in the first direction between the neutral position and the first end position to control rotation of the rope grab in a first direction, and rotating the handle in the second direction between the neutral position and the second end position control rotation of the rope grab in a second direction. This aspect provides similar advantages as discussed in relation to the previous aspect of the invention.

According to a still further aspect of the invention there is provided a computer program product comprising a computer readable medium having stored thereon computer program means for controlling a portable power driven system configured for advancing a rope, wherein the computer program product comprises code for performing the steps as discussed above in relation to the previous aspect of the invention. Also this aspect provides similar advantages as discussed in relation to the previous aspects of the invention.

The computer program product is typically executed using a control unit, preferably including a micro processor or any other type of computing device. Similarly, a software executed by the control unit for operating the inventive portable power driven system may be stored on a computer readable medium, being any type of memory device, including one of a removable nonvolatile random access memory, a hard disk drive, a floppy disk, a CD-ROM, a DVD-ROM, a USB memory, an SD memory card, or a similar computer readable medium known in the art. Accordingly, operation of the portable power driven system may be at least partly automated, implemented as e.g. software, hardware and a combination thereof.

Further features of, and advantages with, the present invention will become apparent when studying the appended claims and the following description. The skilled addressee realize that different features of the present invention may be combined to create embodiments other than those described in the following, without departing from the scope of the present invention.

BRIEF DESCRIPTION OF THE DRAWINGS

The various aspects of the invention, including its particular features and advantages, will be readily understood from the following detailed description and the accompanying drawings, in which.

DETAILED DESCRIPTION

Figure 1:
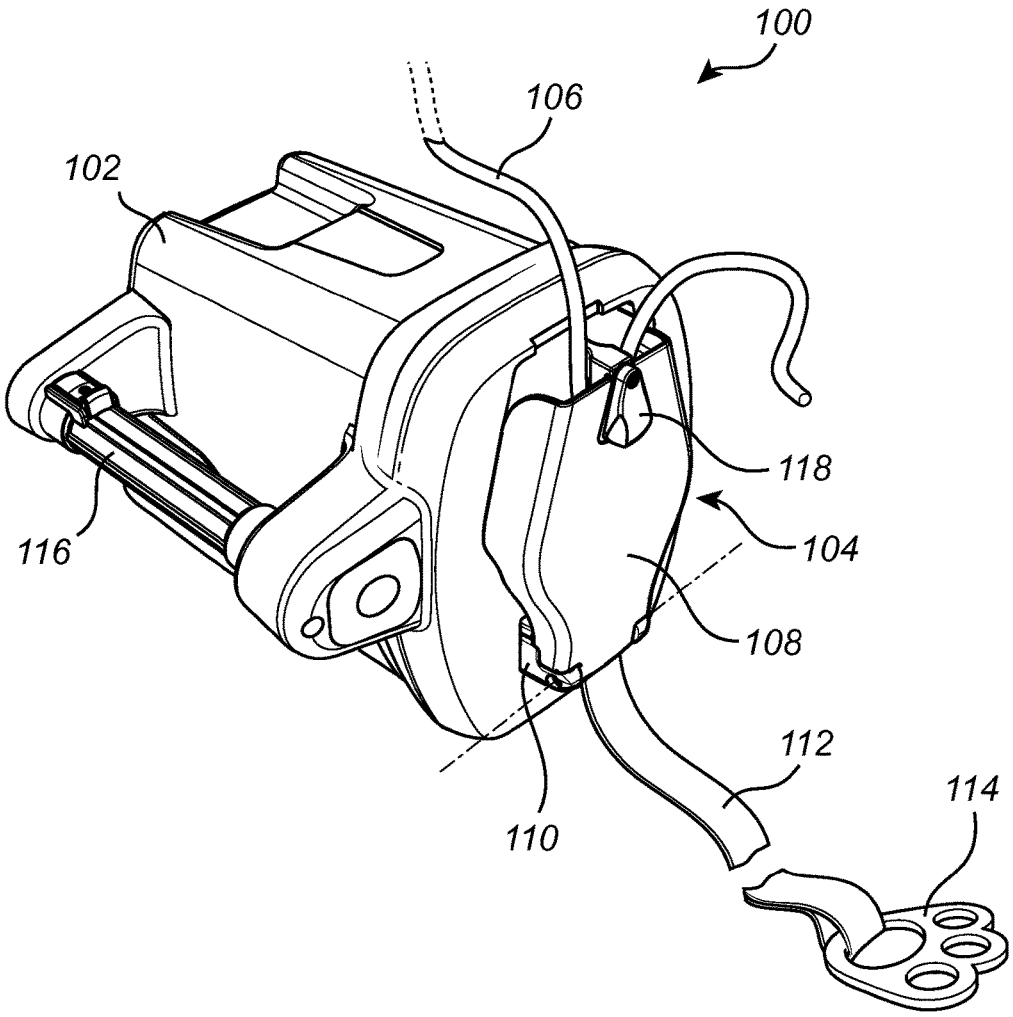
FIG. 1 shows a section of a portable power driven system according to the invention.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

Figure 2:
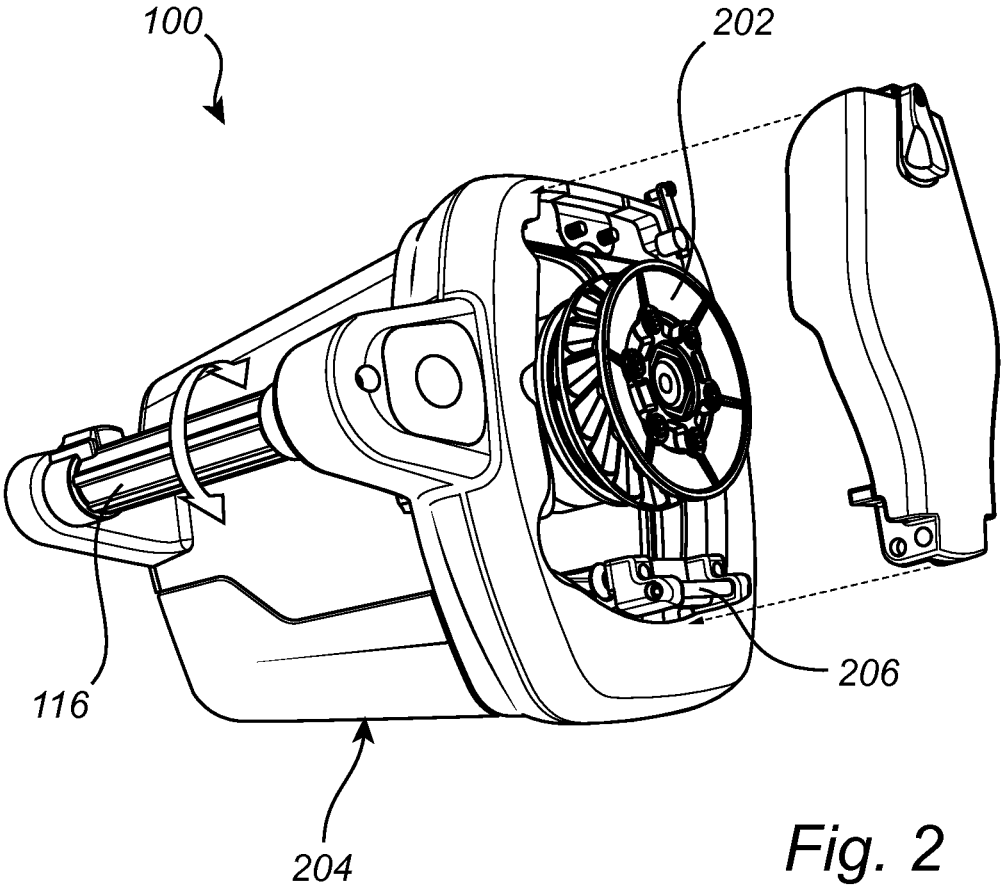
FIG. 2 shows a detailed partially exploded view of the power driven system.

Referring now to the drawings and to FIGS. 1 and 2 in particular, there is depicted a portable power driven system 100 according to a possible embodiment of the invention. The power driven system 100 comprises a motor and a rope grab 202, the motor and the rope grab 202 being connected to each other by means of for example a drive shaft (possibly also including a gearbox or similar). The motor is an electrical motor further comprising a rechargeable battery 204, the rechargeable battery 204 possibly being removably attached to the system 100. In the illustrated embodiment the motor and the drive shaft are enclosed in a main body 102 of the system 100. The system 100 further comprises a hinged safety arrangement 104 for covering the rope grab 202, the rope grab 202 being configured for receiving and advancing a rope 106 once the motor by means of the drive shaft rotates the rope grab 202. Preferably, the portable power driven system 100 is configured to be waterproof.

The hinged safety arrangement 104 includes a safety lid 108 and a leaver portion 110, together configured to engage with a hinge device connected to the main body 102. The leaver portion 110 in turns includes an anchoring point, typically implemented with an elongated pin 206, bolt or similar. In addition, for introducing an anchoring force to the system 100, an elongated textile safety sling 112 is provided, the sling 112 being in one end connected to the elongated pin 206 and in the other end connected to for example a rigging plate 114. Other alternative types of similar devices may be used instead of the rigging plate 114, such as for example a maillon or a carabiner. The rigging plate 114 (or similar) may in turn allow a user to connect his/her safety harness (not shown) to the system 100 during its operation.

In addition, the portable system 100 further comprises a user interface, implemented by means of a rotatable handle 116, for controlling the direction and rotational speed of the motor. Furthermore, the safety arrangement 104 may additionally comprise a locking/unlocking mechanism 118 for opening/closing the safety arrangement 104.

Figure 3A:
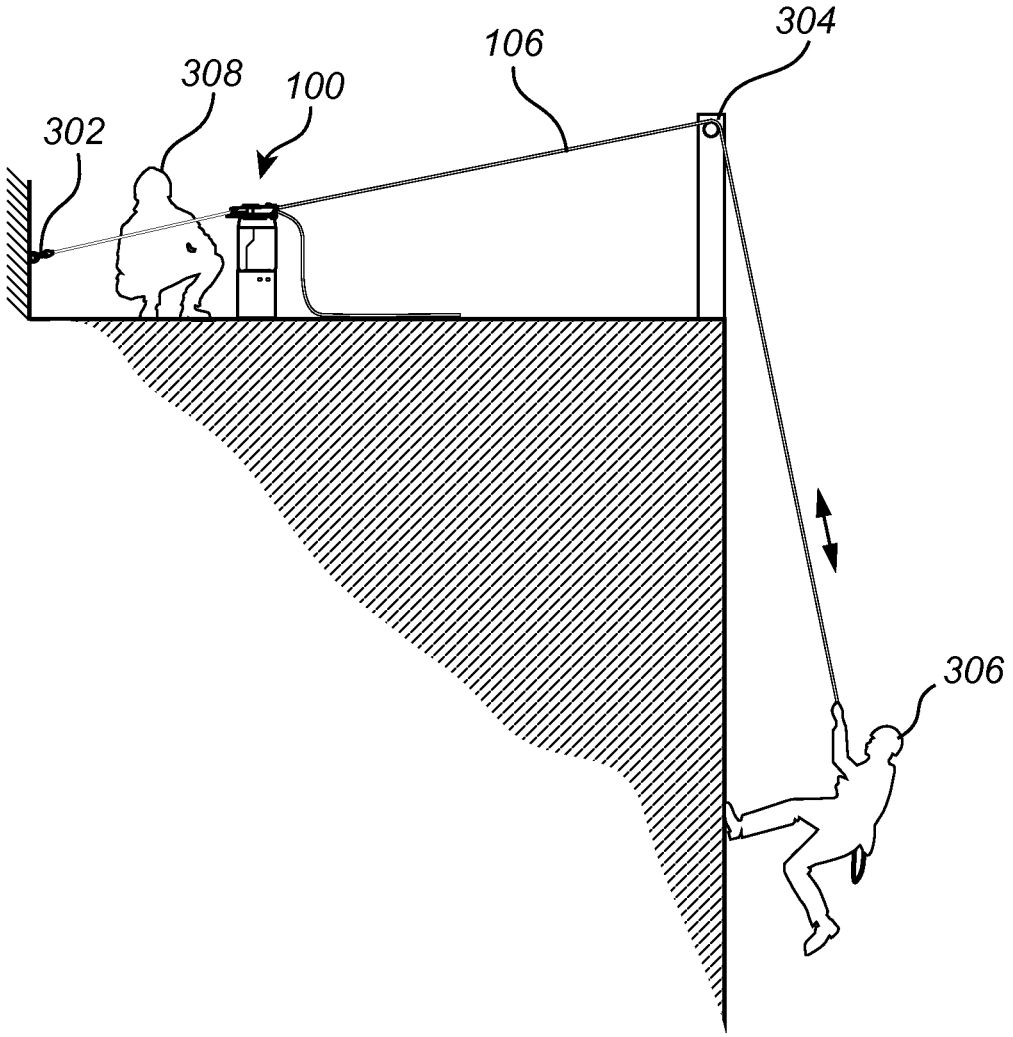
FIGS. 3A and 3B illustrate a horizontal and a vertical operation of the power driven system, respectively.
Figure 3B:
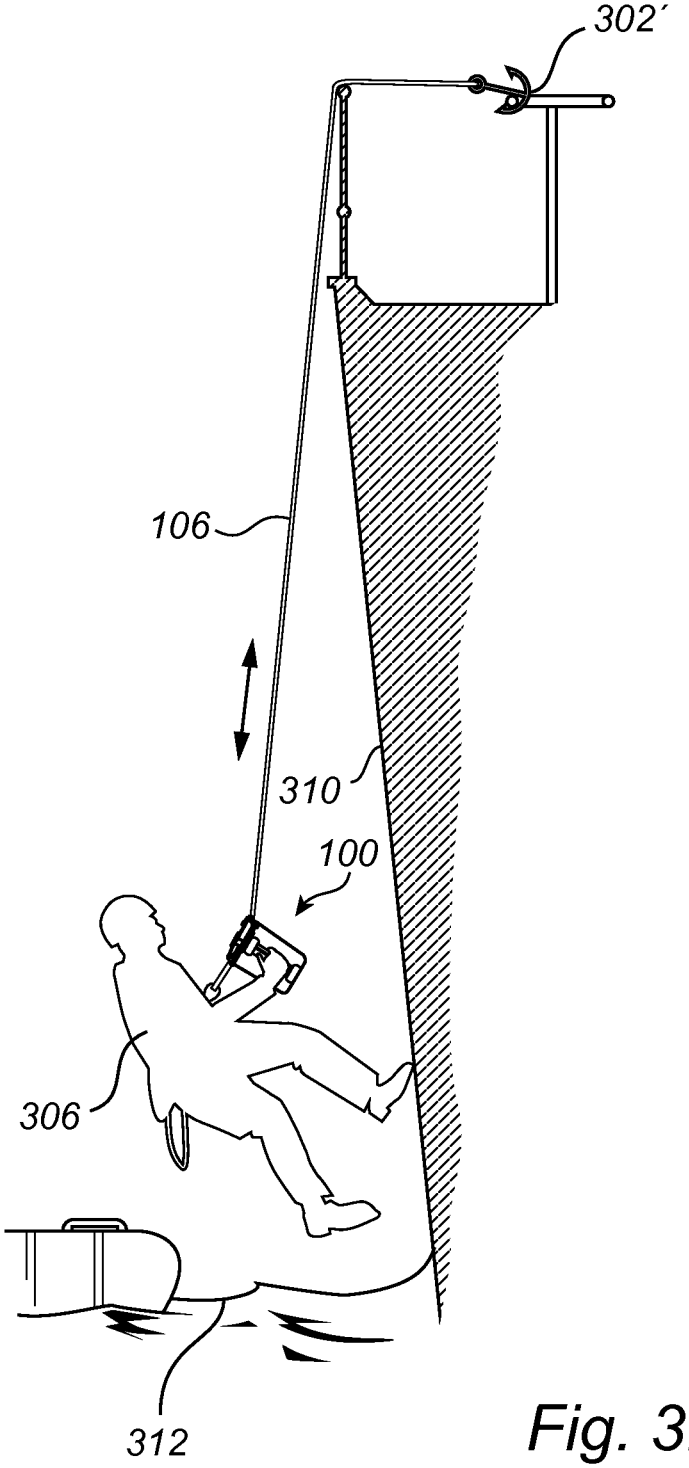

Turning now to FIGS. 3A and 3B, which illustrates the exemplary horizontal and vertical operation, respectively, of the power driven system 100. In the embodiment of FIG. 3*a*, the system 100 is arranged as a standalone winch mode, i.e. instead of the user connecting his/her safety harness directly to the elongated pin 206 (the anchoring point) and using the system 100 to ascend/descend along the rope 106, the system 100 is in this mode connected to a fixed structure 302 such as a wall or similarly available object at the operational site.

In the illustrated example, the rope 106 is configured to pass over e.g. a roller 304 for the purpose of allowing a user 306 to be transporter in a vertical manner without having to himself control the system 100. The system may instead (or also) be controlled by an operator 308 using the user interface 116, the operator 308 typically situated adjacently to the system 100. It may however be possible to configure the system 100 to additionally comprise means to be controlled from a distance, for example by means of a remote control (wired or wireless, not shown). Preferably, the control is wireless and in such an implementation the system 100 comprises wireless connection means to communicate wirelessly with the remote control.

In FIG. 3B, the typical vertical operation scenario for the power driven system 100 is shown. In this scenario, the user 306 having a safety harness is typically connected to the sling 112 in turn connected to the elongated pin 206 of the hinged safety arrangement 104. The rope 106 will in this case typically be arranged at a position 302' above the user 306 (sometimes in relation to climbing denoted as "top rope"). In some possible scenarios of operation of the system 100, the fixed tope rope position 302' above the user 306 may be somewhat flexibly arranged, for example by means of a rope launcher, a pole or any type of tactical hooks. FIG. 3B explicitly illustrates a tactical marine access of a vessel 310 (e.g. a ship), where the user 306 accesses the vessel 310 from a sea level 312.

Figure 4A:
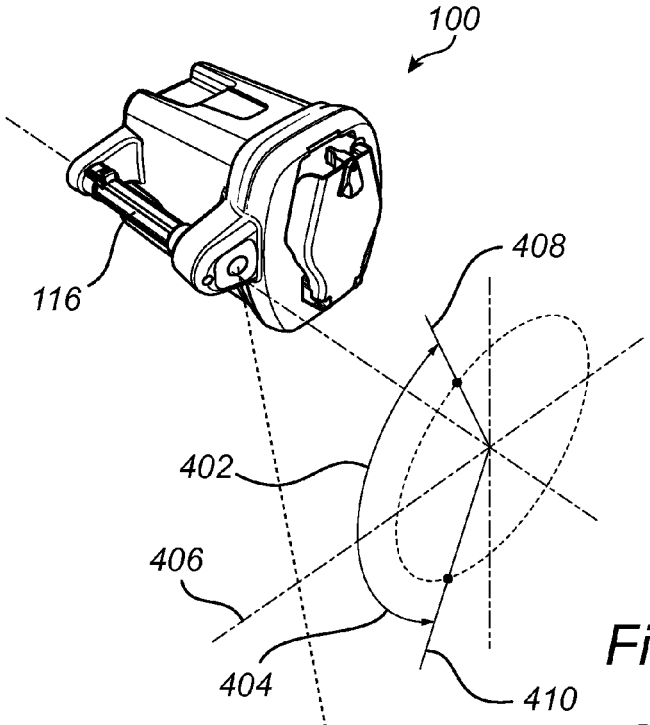
FIG. 4A shows detailed views of portions of the rotatable control handle of the power driven system, demonstrating rotation directions.
Figure 4B:
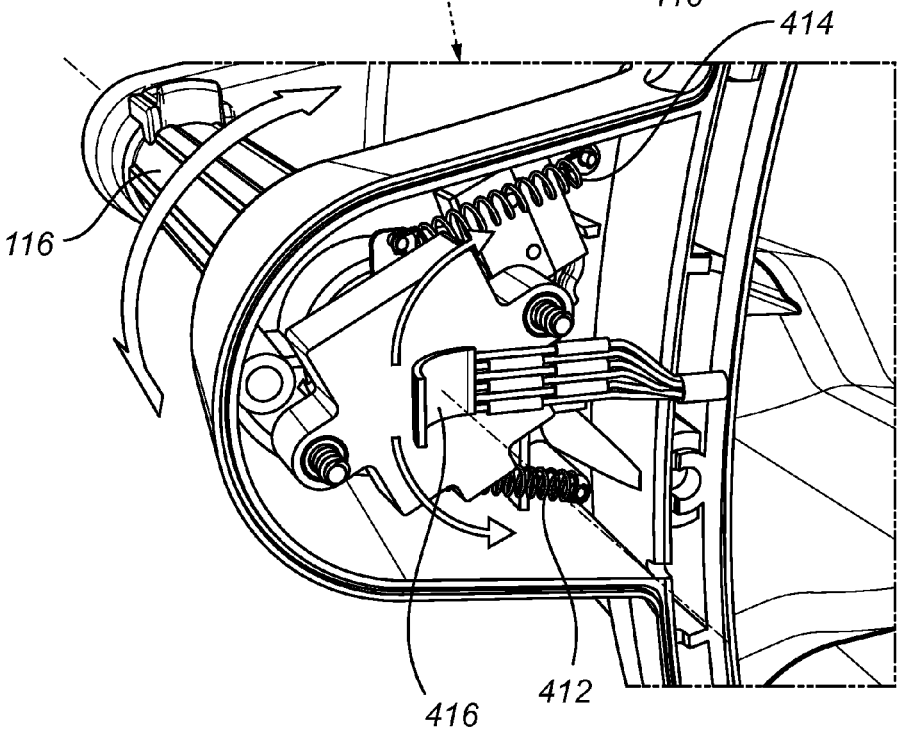
FIG. 4B shows a mechanical implementation of the control handle.

In FIGS. 4A and 4B there are illustrated detailed views of portions of the rotatable control handle 116 of the power driven system. As shown in FIG. 4A and as discussed above, the rotatable handle 116 may be rotated in two directions, i.e. a first 402 and a second 404 rotational direction, typically starting from a neutral position 406. The neutral position 406 may for example be arranged essentially centrally between a first end position 408 (i.e. maximum rotation in the first rotational direction 402) and a second end position 410 (i.e. maximum rotation in the second rotational direction 404).

During operation of the portable power driven system 100, such as in the scenario shown in FIG. 3B, the user 306 will operate the rotatable control handle 116 for ascending/descending between the anchoring point 302' and the sea level 312. Typically, rotating the rotatable control handle 116 in the first direction 402 will generate a rotation of the rope grab 202 in a first direction such that the user 306 will be ascending from the sea level 312 in a direction towards the anchoring point 302' arranged at a height in relation to the sea level 312. Conversely, rotating the rotatable control handle 116 in the second direction 404 will generate a rotation of the rope grab 202 in a second direction such that the user 306 will be descending from the anchoring point 302' in a direction towards the sea level 312.

The control functionality for achieving the multidirectional control handle 116 will typically be implemented using a combination of mechanical components and hardware/software for controlling the operation of the motor. The mechanical implementation of the control handle 116 is also shown in FIG. 4B. Specifically, in one exemplary implementation of the control handle 116, the control handle 116 will be spring loaded using a first 412 and a second spring 414. The springs 412/414 will act on the handle 116 "forcing" the rotation of the handle 116 towards the neutral position 406 once operated by the user 302'. The control handle 116 typically also includes one or a plurality of position sensors 416 configured for identifying a current rotational angel of the handle 116.

It may be possible to implement the functionality of forcing" the rotation of the handle 116 towards the neutral position 406. As an alternative, it may be possible to arrange a torsion spring inside or adjacently to the handle 116. Such an alternative implementation may be advantageous in case of limited space for mounting and or for adapting the control feel provided when operating the handle 116.

Figure 5:
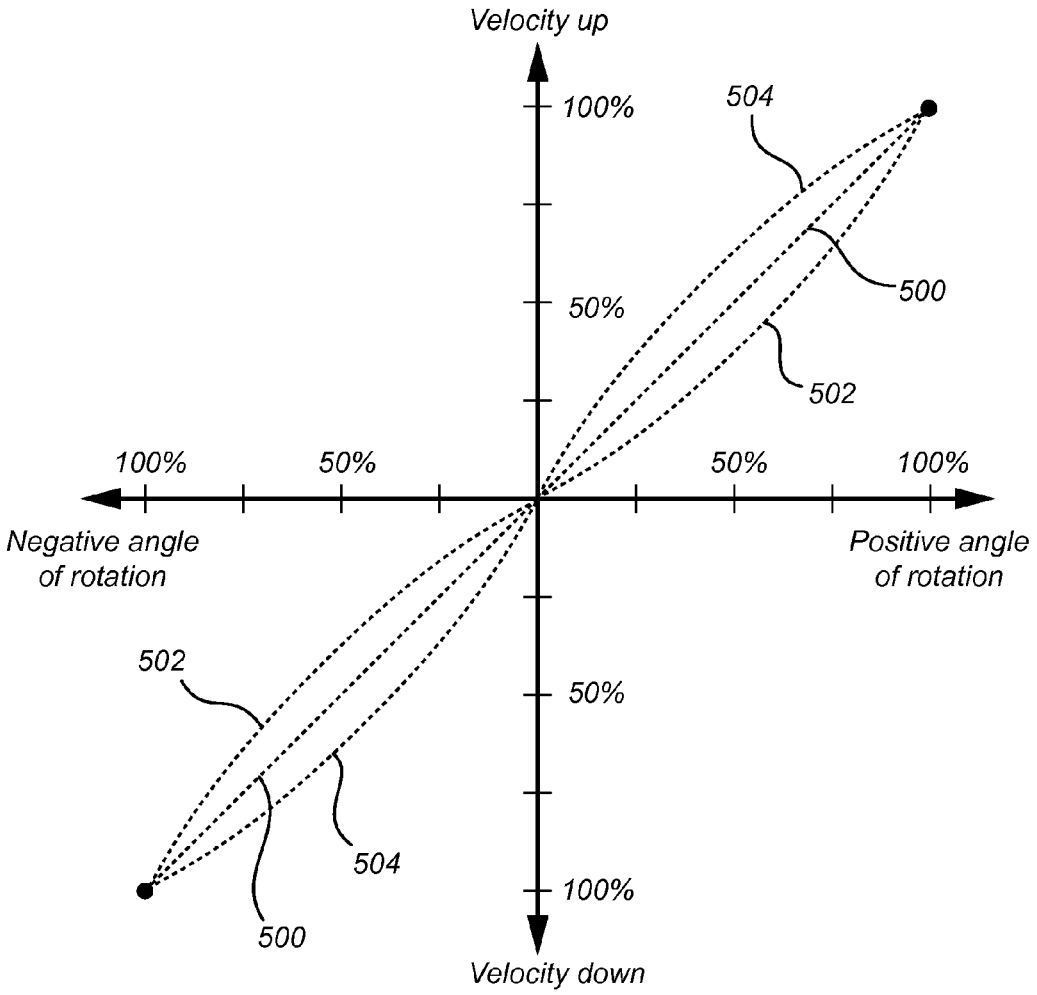
FIG. 5 provides a diagram illustrating possible control curves implemented for controlling the power driven system.

Turning finally to FIG. 5, disclosing a diagram illustrating possible control curves implemented for controlling the power driven system 100. As mentioned above, the control of the operation of the motor of the power driven system 100 may partly be implemented also using electronic hardware and/or software components, for example implemented using a control unit comprised with the power driven system 100. Accordingly, such a possibility may for example allow for an adaptation of how the motor will respond to a rotation of the handle 116.

The control unit is typically electrically connected to the position sensor 416, and receives sensor data being indicative of a current rotational angle of the handle 116. The sensor data from the position sensor 416 may be manipulated as desired, and in one possible embodiment the sensor data is only manipulated for removing possible transients from the position sensor 416, i.e. allowing a linear control of the motor in relation to the rotational angle of the handle 116. That is, there is provided a linear relation between the angle with which the handle 116 is rotated and the speed at which the motor rotates the rope grip 206, as is indicated by the control curve 500 shown in FIG. 5.

In an alternative embodiment, the relationship between the angle with which the handle 116 is rotated and the speed at which the motor rotates the rope grip 206 may be non-linear, taking into account a predetermined correlation function for the speed of rotation of the rope grab and the rotational angle of the handle. Specifically, there is a possibility to allow for a somewhat higher "resolution" when e.g. the rotational angel is below 50%, counting from the neutral position 406 to the first/second 402/404 end position as is indicated by the control curve 502 shown in FIG. 5.

Conversely, in a further alternative embodiment, the situation may be the opposite, i.e. allowing for a somewhat higher "resolution" when e.g. the rotational angel is above 50%, counting from the neutral position 406 to the first/second 402/404 end position as is indicated by the control curve 504 shown in FIG. 5.

Still further, it may be possible to allow for a combination of any of the above exemplified implementations, e.g. providing a linear relation when rotating the handle 116 in the first direction 402 and a non-linear relation when rotating the handle 116 in the second direction 404. Additionally, the neutral position 406 may be positioned anywhere between the first 408 and the second 410 end positions, i.e. not necessarily centrally.

The selected correlation curve may also be implemented to handle any un-linearity relating to the above discussed mechanical components of the handle 116, in combination with either a linear or a non-linear relation between the rotational angle of the handle 116. The correlation curve may for example be implemented as a function depending on sensor data provided from the position sensor(s) 416, or as a look up table for example stored in an electronic memory provided in relation to the control unit.

In summary, the present invention relates to a portable power driven system for advancing a rope, the rope extending in a first main direction, the power driven system comprising an electrical motor, the electrical motor comprising a drive shaft, a rechargeable battery electrically connected to and configured for powering the electrical motor, a rope grab configured to receive the rope, the rope grab connected to the drive shaft of the electrical motor for rotation of the rope grab, a user interface configured for allowing a user to control the speed and direction for advancing the rope, and a main body for mounting the electrical motor, the battery, the rope grab and the user interface, the main body further comprising an anchoring point adapted to receive an anchoring force, the anchoring force extending in a second direction being essentially opposite to the first main direction, wherein the user interface comprises a rotatable handle configured to be rotated in a first and a second rotational direction, the handle having a neutral position, a first end position in the first rotational direction and a second end position in the second rotational direction, and wherein rotation of the handle in the first direction between the neutral position and the first end position generates a rotation of the rope grab in a first direction, and rotation of the handle in the second direction between the neutral position and the second end position generates a rotation of the rope grab in a second direction.

The invention is based on the understanding that the operation of the portable power driven system may be simplified in comparison to prior art devices by allowing a combined functionality of the user interface, provided in one single handle. The handle may accordingly be operated using a single hand of the user, making it possible for the user to at all times keep his hand at the handle and thus making it possible to rapidly change the direction in which the user is advancing the rope. Such a possibility may be specifically useful in relation to a military application where for example the user is approaching a possible enemy. In case of increased danger, the user may directly, without having to move his hand for operating a complex user interface, just switch rotational direction of the handle to rapidly move away form the possible danger and into safety.

The present disclosure contemplates systems, methods and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps. Additionally, even though the invention has been described with reference to specific exemplifying embodiments thereof, many different alterations, modifications and the like will become apparent for those skilled in the art. Variations to the disclosed embodiments can be understood and effected by the skilled addressee in practicing the claimed invention, from a study of the drawings, the disclosure, and the appended claims. Furthermore, in the claims, the word "comprising" does not exclude other elements or steps, and the indefinite article "a" or "an" does not exclude a plurality.

The invention claimed is:

1. A portable power driven system for advancing a rope, the rope extending in a first main direction, the power driven system comprising:

an electrical motor, the electrical motor comprising a drive shaft;

a rechargeable battery electrically connected to and configured for powering the electrical motor;

a rope grab configured to receive the rope, the rope grab connected to the drive shaft of the electrical motor for rotation of the rope grab;

a user interface configured for allowing a user to control the speed and direction for advancing the rope, and a main body for mounting the electrical motor, the battery, the rope grab and the user interface, the main body further comprising an anchoring point adapted to receive an anchoring force, the anchoring force extending in a second direction being opposite to the first main direction, wherein the user interface comprises a rotatable handle configured to be rotated in a first and a second rotational direction, the handle having a neutral position, a first end position in the first rotational direction and a second end position in the second rotational direction, and wherein rotation of the handle in the first direction between the neutral position and the first end position generates a rotation of the rope grab in a first direction, and rotation of the handle in the second direction between the neutral position and the second end position generates a rotation of the rope grab in a second direction; a hinged safety arrangement comprising a safety lid configured to be arranged in a closed state to cover the rope grab during operation of the power driven system, and to be arranged in an opened state for allowing introduction of the rope to the robe grab.

2. The portable power driven system according to claim 1, wherein the rotational speed of the rope grab is based on the rotational angle of the handle.

3. The portable power driven system according to claim 1, wherein the rotational speed of the rope grab is based on the rotational angle of the handle and a predetermined correlation function for the speed of the rope grab and the rotational angle of the handle.

4. The portable power driven system according to claim 3, wherein the predetermined correlation function is non-linear.

5. The portable power driven system according to claim 1, wherein the neutral position is centrally arranged in relation to the first and the second end position.

6. The portable power driven system according to claim 1, wherein the neutral position is non-centrally arranged in relation to the first and the second end position.

7. The portable power driven system according to claim 1, wherein the handle of the user interface is positioned at the main body within an arms length of a user securely connected to the anchoring point.

8. The portable power driven system according to claim 7, wherein the handle of the user interface is positioned for allowing the user to control the handle between the first and the second end position when operated by a hand of the user.

9. The portable power driven system according to claim 1, wherein the rope grab has a concave form comprising a plurality of ridges for frictionally engaging the rope.

10. The portable power driven system according to claim 1, further comprising a safety sling connected to the anchoring point, the safety sling arranged to receive at least one of a maillon, a carabiner, or a rigging plate.

11. A method for operation of a portable power driven system for advancing a rope, the rope extending in a first main direction, the power driven system comprising:

an electrical motor, the electrical motor comprising a drive shaft;

a rechargeable battery electrically connected to and configured for powering the electrical motor;

a rope grab configured to receive the rope, the rope grab connected to the drive shaft of the electrical motor for rotation of the rope grab;

a user interface configured for allowing a user to control the speed and direction for advancing the rope, the user interface comprises a rotatable handle configured to be rotated in a first and a second rotational direction, the handle having a neutral position, a first end position in the first rotational direction and a second end position in the second rotational direction, and a main body for mounting the electrical motor, the battery, the rope grab and the user interface, the main body further comprising an anchoring point adapted to receive an anchoring force, the anchoring force extending in a second direction being opposite to the first main direction; a hinged safety arrangement comprising a safety lid configured to be arranged in a closed state to cover the rope grab during operation of the power driven system, and to be arranged in an opened state for allowing introduction of the rope to the robe grab, wherein the method comprises:

rotating the handle in the first direction between the neutral position and the first end position to control rotation of the rope grab in a first direction, and rotating the handle in the second direction between the neutral position and the second end position control rotation of the rope grab in a second direction.

12. Computer program product comprising a computer readable medium having stored thereon computer program means for controlling a portable power driven system configured for advancing a rope, wherein the computer program product comprises code for performing the steps according to claim 11.

* * * * *